US005108017A

United States Patent [19]

Adamski, Jr. et al.

[11] Patent Number: 5,108,017

[45] Date of Patent: Apr. 28, 1992

[54] SLEEVE FLIP OVER DEVICE

[75] Inventors: Maximilian Adamski, Jr., Palatine; Stephen Ruderman, Oak Park, both of Ill.

[73] Assignee: Union Special Corporation, Chicago, Ill.

[21] Appl. No.: 578,769

[22] Filed: Sep. 6, 1990

[51] Int. Cl.[5] ..... A41H 33/00

[52] U.S. Cl. ..... 223/37; 223/38; 493/23; 493/423; 493/418

[58] Field of Search ..... 223/37, 38; 493/1, 2, 493/19, 23, 418, 423

[56] References Cited

U.S. PATENT DOCUMENTS

| | | | |
|---|---|---|---|
| 3,493,226 | 2/1970 | Weir | 493/23 |
| 3,685,818 | 8/1972 | Burger et al. | 223/37 X |
| 3,698,705 | 10/1972 | Funk et al. | 493/23 X |
| 3,904,186 | 9/1975 | DeLigt | 493/423 X |
| 3,975,009 | 8/1976 | Brown | 493/19 X |
| 4,234,179 | 11/1980 | Weir | 493/418 X |
| 4,784,381 | 11/1988 | Prochut et al. | 112/10 X |
| 4,800,830 | 1/1989 | Adamski et al. | 112/272 X |

*Primary Examiner*—Werner H. Schroeder
*Assistant Examiner*—Bibhu Mohanty
*Attorney, Agent, or Firm*—Morgan & Finnegan

[57] ABSTRACT

A method and apparatus for flipping and folding a pliable workpiece, such as a pre-hemmed sleeve blank, along a desired fold axis. A workpiece is conveyed past a flipping roller and down against a clamp bar wherein it is clamped at a predetermined time by a lower hem guide. The flipping roller is sped to impart linear momentum to the unclamped, trailing portion of the workpiece. The flipping action serves to re-orient the workpiece from a right side-up orientation to an inside-out orientation so as to properly present the workpiece for subsequent seaming or stitching operations. A sensor is provided to determine the length of the workpiece so as to enable the device to clamp the workpiece about any desired fold axis.

18 Claims, 11 Drawing Sheets

CLAMP POSITION 134

SLEEVE FLIP OVER DEVICE

FIELD OF THE INVENTION

The present invention relates to an apparatus and method for flipping and folding a workpiece on an assembly line.

BACKGROUND OF THE INVENTION

The present invention is an improvement on the method and apparatus for post-hemming sleeve handling as disclosed in U.S. Pat. No. 4,800,830 ("'830"), "Hemmer Seamer Assembly", assigned to Union Special Corporation, whose disclosure is incorporated by reference herein. The invention taught by the '830 patent will produce a finished sleeve with a hem configuration which leaves the post-hemmed sleeve blank in an inside-out orientation, e.g., the hemmed overlap lies directly on top of the sleeve blank. One such type of hem is the so-called 503 EFc-1 type hem.

As is discussed in the '830 patent, a cloth pickup having opposed jaws 72, 74 is employed to grip a wrong-side up hemmed sleeve blank B so as to transport the sleeve blank from a first conveyor 22 (the sleeve blank having been previously subjected to a hemming machine 40 producing, for example, the 503 EFc-1 type hem) to a second conveyor 24 so as to transport the sleeve blank to a seaming machine for sewing a seam, thereby finishing the sleeve. The cloth pickup device employed by the device in the '830 patent is similar to that disclosed in U.S. Pat. No. 4,784,381, ("'381"), "Cloth Pickup Device," assigned to Union Special Corporation, whose disclosure is incorporated by reference herein.

In the '830 patent, an actuating member 100, having a plurality of upwardly directed blades 104(*a–e*), projects through an opening plate 102 in the conveyor 22 to engage the wrong sideup, hemmed sleeve blank B, thereby projecting it between the open jaws 72, 74 of the cloth pickup device 42. This action also serves to fold the previously flat sleeve blank B about the blades 104 (*a–e*). The blades of the actuating member 100 also engage a plate 90 pivotally mounted on the jaw 74 so as to move the jaws 72, 74 to a closed configuration, thereby securely gripping the sleeve blank B.

As the gripped sleeve blank B proceeds towards the second conveyor 24, a lower hem guide 150 is raised, thereby urging the hem guide 150 between the plies of folded hemmed sleeve blank B. Blowers 144 and 180 blow against the top and bottom plies, respectively, of sleeve blank B so that the sleeve blank registers against a guide plate 156, thereby maintaining the post-hemming registration of the sleeve blank.

After the trailing edge of the hemmed sleeve blank has passed over the end of conveyor 22, a clamping mechanism 130 associated with an upper hem guide clamps the trailing edge of sleeve blank B so as to ascertain that the sleeve blank B will be properly positioned on conveyor 24. The lower hem guide 150 is then lowered. The pickup device 42 then returns to its home position so as to prepare for the pickup of another sleeve blank B.

As evident from the '830 patent, the folded sleeve blank B that is placed on conveyor 24 has a central fold F. The sleeve blank proceeds to a seaming station, where it is sewn into the configuration of a sleeve.

The prior configuration as taught in '830 was adapted to process sleeve blanks which were hemmed with the 503 EFc-1 or similarly oriented hem. As the sleeve blank emerges from that hemming machine, the hemmed sleeve blank emerges wrong side-up. Thus, only a single operation—folding the hemmed sleeve blank—must be thereafter performed in order to properly orient the sleeve blank prior to the seaming operation.

However, garment manufacturers, in the interest of aesthetics and fashion, have increasingly come to desire sleeves formed with another type of hem in which a hem leaves the post-hemmed sleeve blank in a right-side up orientation, e.g., the hemmed overlap lies below the sleeve blank. One type of this hem is the 406 EFa-1 type-hem. In hemming machines designed to produce the 406 EFa-1 type hem, the sleeve blank typically emerges from the hemming machine in a right-side up orientation. A mechanism must therefore be provided to recognize and position such workpieces prior to further stitching operations.

Accordingly, it is an object of the present invention to provide a method and apparatus for conveniently re-orienting a pre-stitched workpiece such as a pre-hemmed sleeve blank.

It is a further object of the invention to provide a method and apparatus for flipping over and folding a pre-hemmed sleeve blank during a hemming and seaming operation.

It is still another object of the present invention to provide a method and apparatus for flipping and folding a pre-hemmed sleeve blank, which emerges from the hemming machine right side-up, that maintains registration of the sleeve blank and insures proper alignment of the folded sleeve.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

These and additional objects are met by providing an apparatus and method according to the present invention. It will be understood to those skilled in the art that the principles taught herein are not solely applicable to the processing of sleeve blanks. They may be applied, for example, to any pliable material, particularly components of wearing apparel, which can be laid flat and thereafter folded for subsequent processing. Accordingly, in one embodiment according to the invention, a laid-flat pre-hemmed sleeve blank is conveyed along a standard conveyor and emerges from the hemming station right side-up. In order to properly orient the sleeve blank for seaming, the blank should be flipped inside-out prior to folding and presentation to a seaming machine.

A sensor, connected to a central processing unit ("CPU"), is conveniently located a known distance from the sleeve blank clamping point and over the conveyor belt downstream of the hemming station but prior to the end of the conveyor. The sensor measures the length of the sleeve blank. Given the known conveyor speed, the sleeve blank may thus be clamped and folded about its medial or other desired fold axis. Additionally, the sensor will coordinate the synchronization of the activities of the device regardless of how far apart the sleeve blanks are placed on the conveyor.

The sleeve blank is conveyed towards and over a motor-actuated flip-over roller located at one end of the conveyor belt. The sleeve blank will continue past a number of stripper arms and a clamp bar located below the flip-over roller. A lower hem guide is then activated from a neutral, home position to a sleeve pick-up position. As the midpoint of the sleeve passes over the clamp bar, the lower hem guide engages against the clamp bar, thereby clamping the sleeve.

After clamping the flip-over roller increases its rotational speed. This sudden acceleration to the trailing portion of the sleeve bank causes the trailing portion to flip over the lower hem guide. The leading half of the sleeve thus remains clamped between the clamp plate and one side of the hem guide, while the trailing half of the sleeve blank is draped over and around the opposing side of the lower hem guide. The lower hem guide then retracts to the pickup position.

Simultaneous to this ongoing activity, a sleeve pickup device, similar to that taught in the '381 patent, and employed by the device in '830, has been positioned directly over the lower hem guide located in its pickup position with the sleeve blank draped over. A divide-by-two blade, projecting longitudinally through an aperture in the lower hem guide, is activated and projects upward, thereby lifting the sleeve blank along its fold-line into the awaiting jaws of the sleeve pickup device, where it is secured. The divide-by-two blade retracts back into the lower hem guide. The lower hem guide is simultaneously pivoted backwards and up so that the guide travels both towards its home position and towards an elevated, up position while the sleeve pick-up device travels towards an index table.

The sleeve pick-up device travels over the index table while the lower hem guide continues to proceed towards its elevated position. Raising the hem guide will maintain the sleeve plies separated until just prior to placement upon the index table. Thus, the blower and plate alignment mechanism (as described in the '830 patent) may act upon the individual, separated plies of the sleeve blank to maintain registration and alignment thereof.

A clamping mechanism associated with an upper edge guide, such as described in the '830 patent, clamps the trailing edge of the folded sleeve blank against the index table. The clamping serves to prevent any bubbling or folds in the sleeve blank that may occur due to the nature of the material. By imparting a slight stretch to the fabric, the sleeve blank advantageously lays flat on the index table, preventing later misseaming.

Once the sleeve blank is released from the jaws of the sleeve pickup, the lower hem guide is lowered to its home position, the clamping mechanism disengages, and the sleeve pick-up device proceeds to its home position, awaiting to secure the next sleeve blank during the production cycle.

Thus, the present invention modifies the sleeve folding operation taught in the '830 patent, so that when the Hemmer/Seamer employs a hemming machine which produces a 406 Efa-1 type hem, or any other hem that causes the sleeve blank to emerge right side-up from the hemmer, the sleeve blank may be properly re-oriented for presentation to the seaming machine. This is accomplished by flipping the sleeve blank prior to folding so that the sleeve blank is re-oriented inside out.

Additionally, the flipover operation is important because it helps maintain the registration of the sleeve blank. Sleeve blank registration, determined when the sleeve blank emerges from the hemming machine, is necessary to accurately perform subsequent manufacturing operations on the sleeve blank so as to produce a defect-free finished sleeve. Maintaining registration is important for properly aligning the plies of the folded sleeve blank prior to seaming.

BRIEF DESCRIPTION OF THE DRAWINGS

The invention will be described in greater detail by way of reference to the following drawings, in which.

DETAILED DESCRIPTION OF THE DRAWINGS

Figure 1:
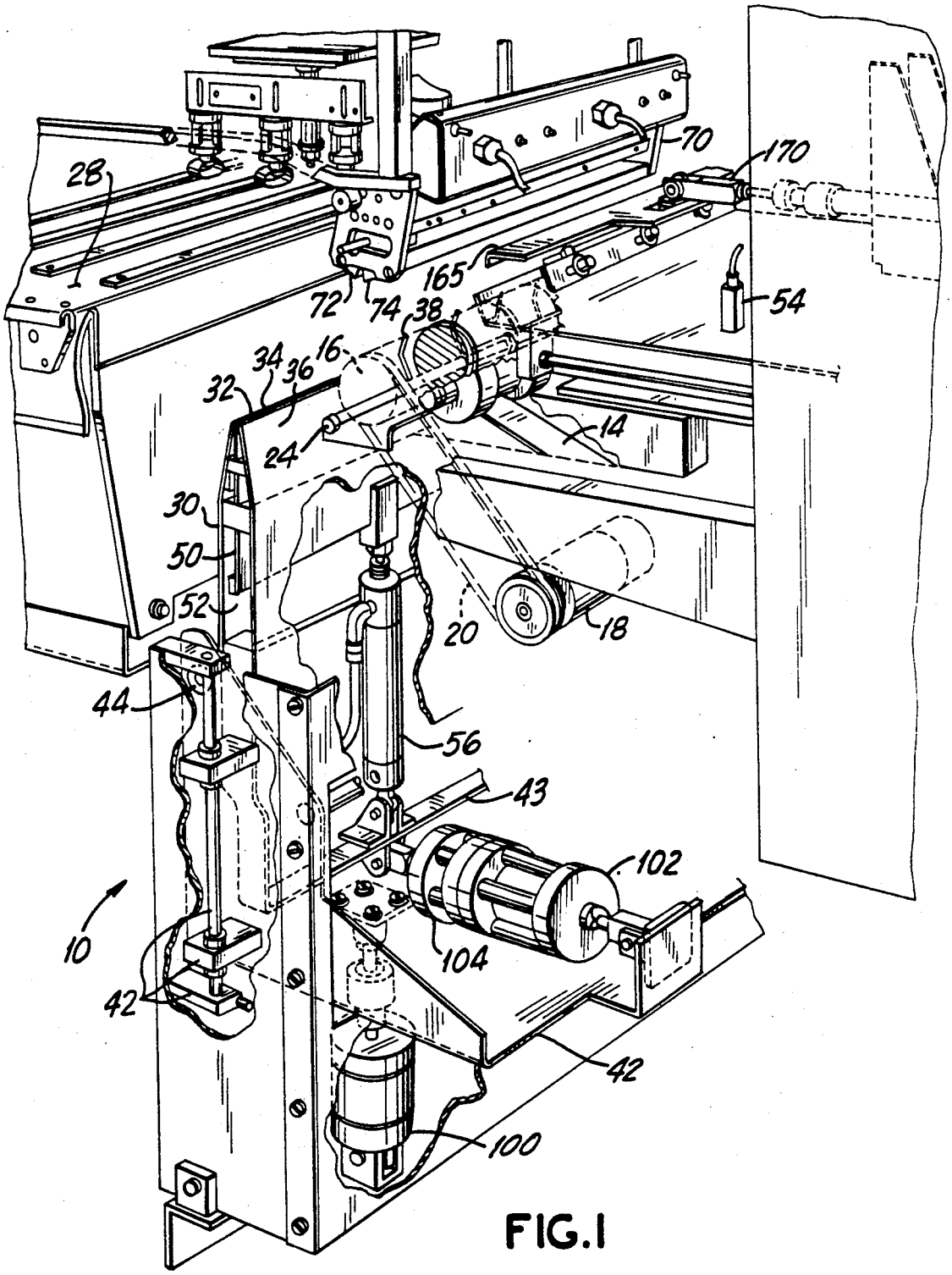
FIG. 1 is a side perspective view according to the invention showing the relationship of the various parts described herein at their rest positions.

Referring now to the drawings, wherein like numerals refer to like components, there is illustrated in FIGS. 1–14 one embodiment of a sleeve flip-over device 10 according to the invention. This sleeve flip-over device 10 is illustrative of an apparatus and method for flipping and folding pre-hemmed sleeve blanks, in preparation for additional manufacturing processes, in conjunction with a hemming and seaming apparatus as taught in U.S. Pat. No. 4,800,830, HEMMER SEAMER AS- SEMBLY, assigned to Union Special Corporation, the assignee hereof. Accordingly, an explanation of various collateral components associated with the present invention but not directly forming a part thereof may be obtained by way of reference to the '830 patent, whose disclosure is incorporated by reference herein.

Figure 2:
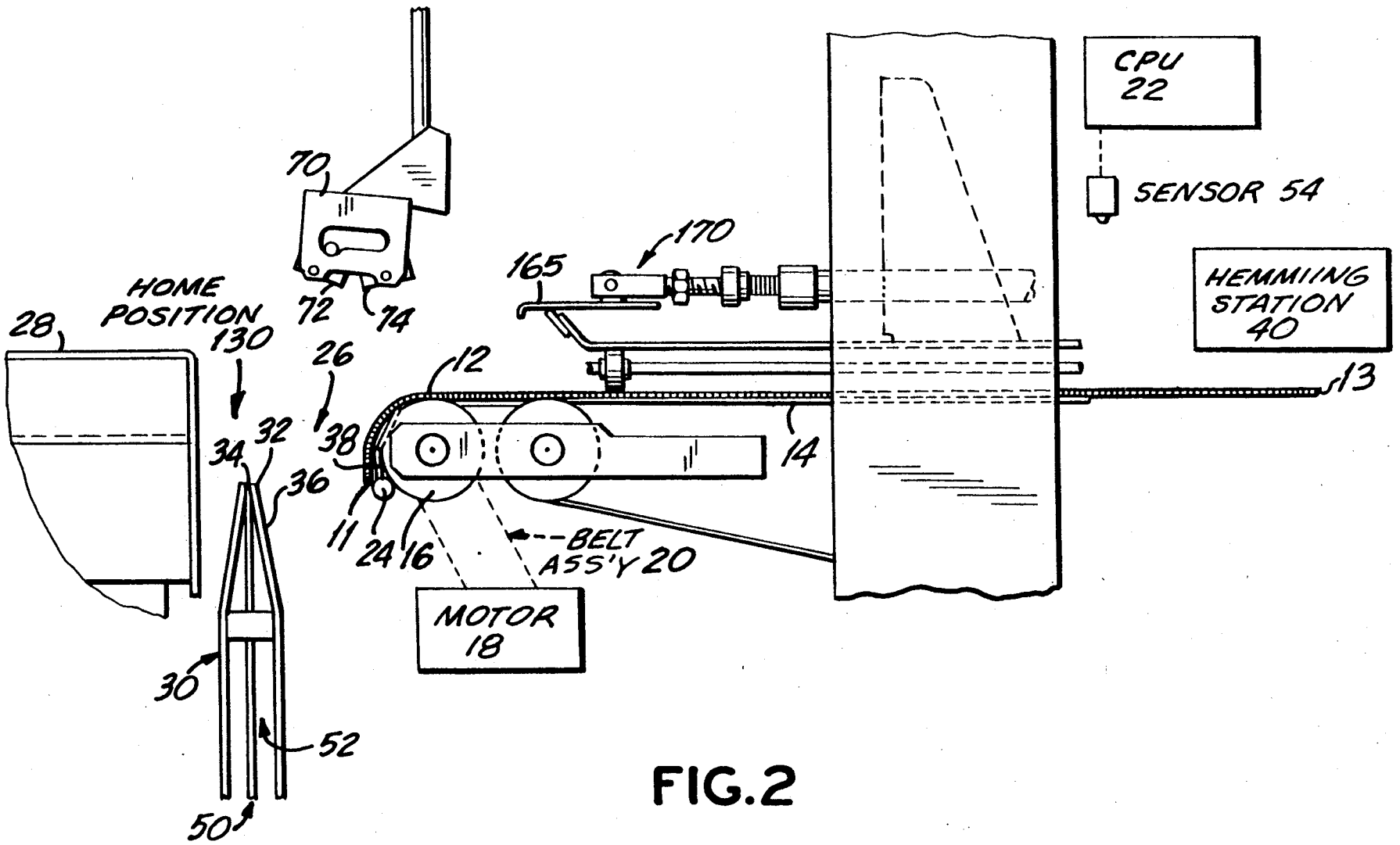
FIG. 2 is a side elevational view illustrating a laid out sleeve blank as its leading edge passes over the flip-over roller and clamping plate.

FIGS. 1 and 2 illustrate one embodiment of the sleeve flip-over device 10 according to the invention. The device 10 is illustrated prior to the beginning of a seaming cycle, e.g., a pre-hemmed, laid flat sleeve blank 12 having emerged from a hemming station 40 which travels towards an index table 28 on conveyor belt 14. Significantly, the sleeve blank 12 emerges from the hemming station oriented right side-up. This may occur, for example, where the hemming machine produces hems such as the 406 Efa-1, where the hemmed material 200 is drawn underneath the sleeve blank 12 prior to or during the hemming operation so that the hemmed overlap rests directly below the bulk of the sleeve blank 12. (See FIGS. 13 and 14) Thus, in order to properly orient the sleeve blank for a seaming or other stitching operation, the sleeve should be flipped inside-out prior to folding.

As the sleeve blank 12 travels towards the end of the conveyor belt 14, it will pass underneath a sensor 54 which serves to control the functioning of the device. The sensor 54, preferably photoelectric but not so limited, detects the leading edge 11 and trailing edge 13 of sleeve blank 12. Given the known speed of the conveyor belt 14 and distance from the sensor 54 to the clamping point (shortly described) on clamping bar 24, the sensor 54 will time the interval between detection of the leading edge 11 and trailing edge 13 so as to measure the length of the sleeve blank 12. Sensor 54 then transmits the data to the central processing unit (CPU) 22 so as to assure that the sleeve blank 12 will be clamped about its medial axis, or any other desired axis, knowing the length of sleeve blank 12 and the time required for the medial or other desired axis to reach clamp bar 24. This arrangement imparts significant flexibility to the device 10, allowing the device to flip and fold a wide range of sleeve blanks regardless of size. Moreover, the device 10 can thereby be rendered self-compensating for the individual placement of the sleeve blanks 12 upon the conveyor belt, as the distance between successive sleeve blanks will vary, an important consideration in insuring the device's ability to accurately fold individual sleeve blanks while operating at a high production rate.

Figure 12:
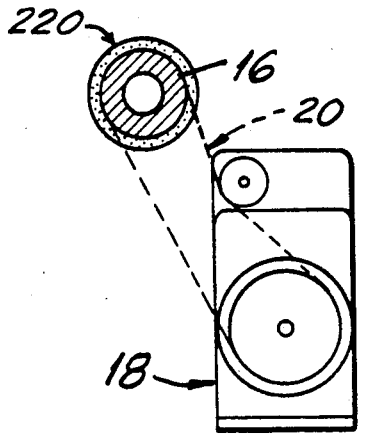
FIG. 12 is a cross-sectional view of the flip-over roller illustrating its covering material and electric motor.
Figure 13:
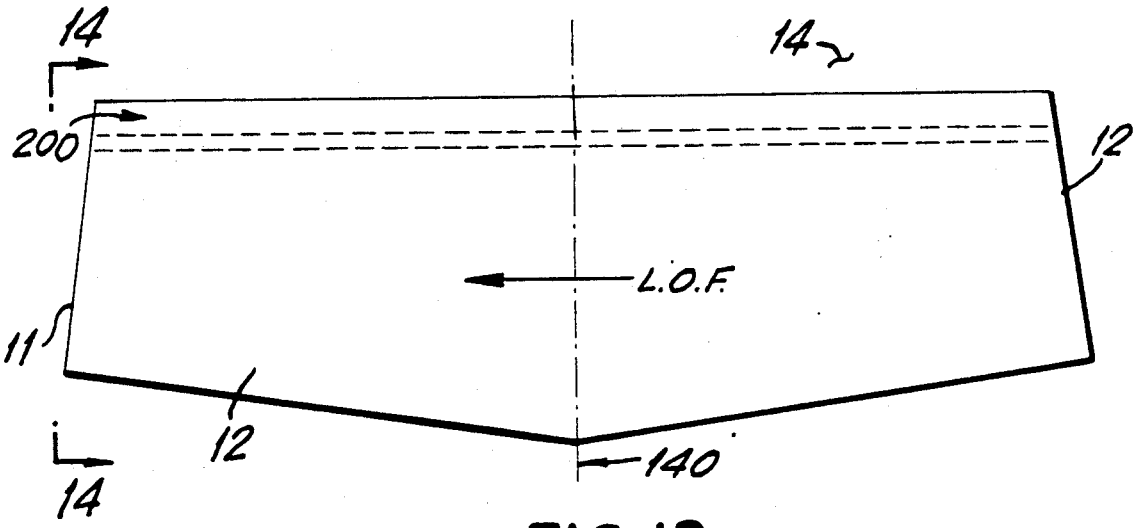
FIG. 13 is an overhead view of the sleeve blank as it proceeds towards the flip-over roller.
Figure 14:
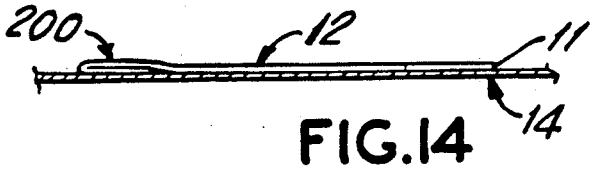
FIG. 14 illustrates the hemmed material drawn underneath the bulk of the sleeve.

A flip-over roller 16 is located at the end of the conveyor belt 14. The flip-over roller 16 may be driven by an electric motor 18 via a belt assembly 20. Advantageously, the rotational speed of electric motor 18 may be stepped up or down, as desired, under the command of a computer or CPU 22. Referring to FIG. 12, the flip-over roller 16 may be covered with a surfacing material 220, such as standard conveyor belting material, for a number of reasons. The belting material serves to impart friction to the sleeve blank 12 so that the sleeve blank 12 will not move about during flip-over, thereby remaining properly aligned. Additionally, the friction exerted by the surfacing material 220 preserves the registration of the sleeve blank 12 previously established as the sleeve blank 12 emerged from the hemming station.

Advantageously, as seen in FIG. 2, a clamp bar 24 is preferably located forward of and slightly below flip-over roller 16. Clamp bar 24 serves as a means for enabling sleeve blank 12 to be secured once a proper length has descended into the gap 26 formed between the flip-over roller 16 and the tapered, front surface 36 of lower hem guide 30. Significantly, a plurality of stripper arms 38, located above the clamp bar 24 and away from flip-over roller 16, will aid in the disengagement of the sleeve blank 12 from the flip-over roller 16. The stripper arms 38 thereby assure that the sleeve blank 12 will fall smoothly from the roughened, covered surface of the flip-over roller 16.

Figure 11:
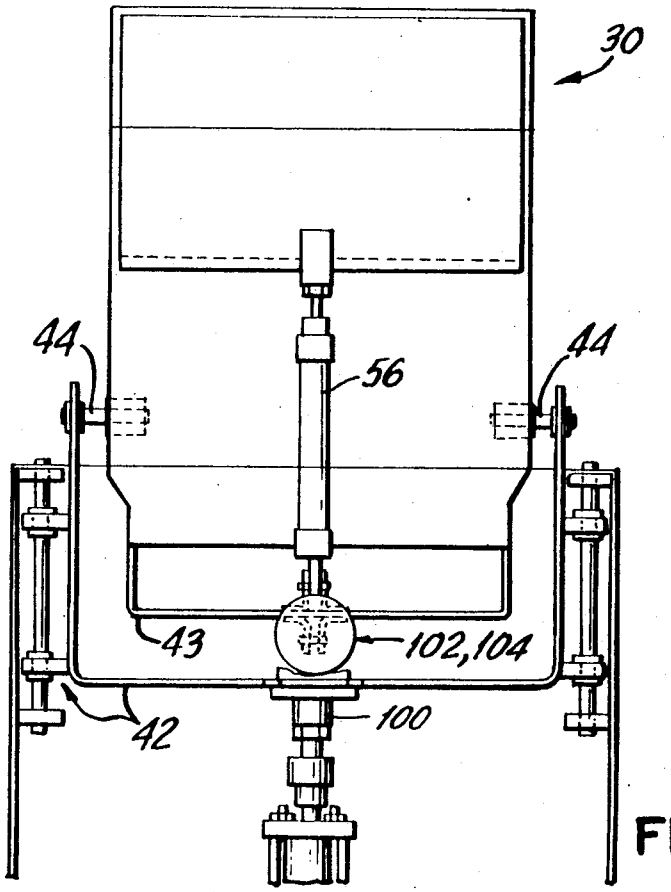
FIG. 11 is a frontal view of one construction and mounting of the lower hem guide.
Figure 10:
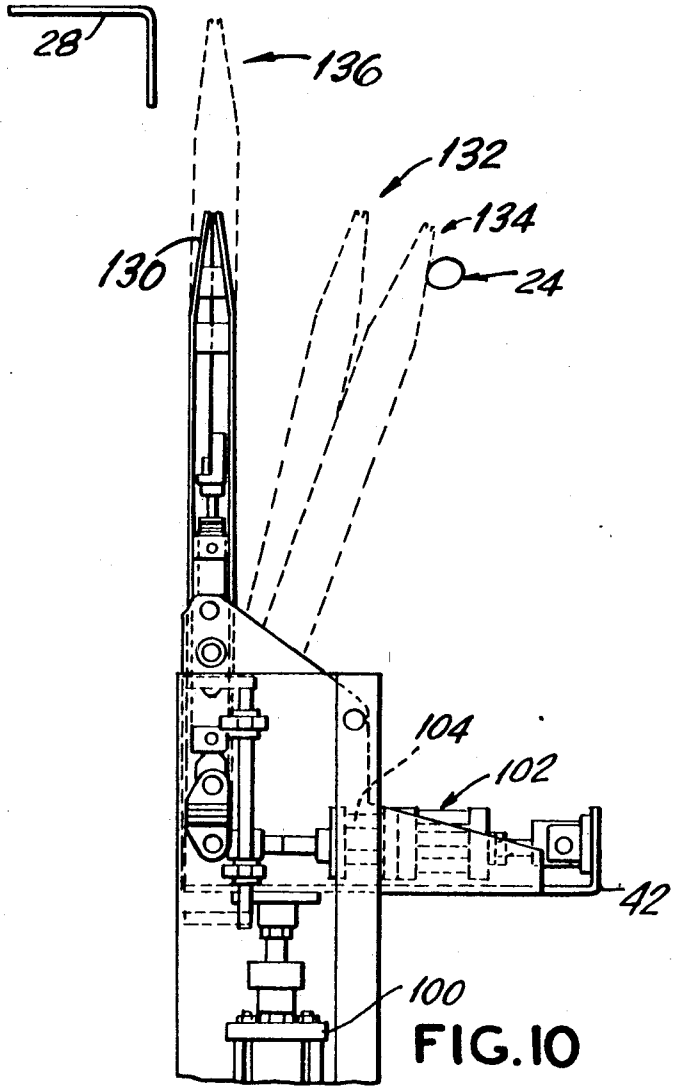
FIG. 10 is a side elevational view illustrating various positions of the lower hem guide during operation of the device.

Referring to FIGS. 1 and 11, a lower hem guide 30 is slidingly mounted via a vertically-oriented U-shaped carriage and rail assembly 42 adjacent to the index table 28. The hem guide 30 may be vertically displaced by an actuating cylinder and piston 100 affixed to the lower end of the rail assembly 42. The cylinder 100 will raise the hem guide 30 from a home position 130 to an elevated position 136.

Additionally, the hem guide 30 is pivotedly mounted within the U-shaped carriage 42 at bearings 44, so that the lower hem guide 30 is free to rotate within the gap 26. A U-shaped bracket 43 is affixed to the bottom of lower hem guide 30. The rotation is actuated by a first actuating cylinder 102 and a second actuating cylinder 104 tandemly connected to the bottom of carriage 42, the cylinders 102, 104 themselves affixed to the bottom of U-shaped bracket 43. Advantageously, first actuating cylinder 102 will rotate hem guide 30 from its home position 130 to a pick-up position 132. Thereafter, while first actuating cylinder 102 remains extended, second actuating cylinder 104 further rotates the hem guide 30 from its pickup position 132 to its clamping position 134 against clamp bar 24.

The lower hem guide 30 preferably includes a straight tapered edge 32 having a slotted opening 34. The tapered edge 32 provides a sharp creasing surface for cleanly folding sleeve blank 12. Advantageously, a divide-by-two ("DBT") blade 50 is actuated from within the hem guide 30. The DBT blade 50 is preferably longitudinally oriented within a gap or opening 52 within lower hem guide 30. When engaged, the DBT blade 50 protrudes through the slotted opening 34 in tapered edge 32. When disengaged, the DBT blade 50 remains embedded within the opening 52 in lower hem guide 30. The DBT blade is actuated via a cylinder and piston 56 fixedly mounted within the opening 52 in lower hem guide 30.

Note that when in the home position 130 the tapered edge 32 rests vertically below the top edge of index table 28. When pivoted into engagement with clamp bar 24, the tapered surface 36 of hem guide 30 rests squarely against the clamp bar 24, providing secure clamping action for the sleeve blank 12.

The operation of the invention will be explained by reference to FIGS. 1–13. As disclosed by FIG. 2, the sleeve blank 12 travels upon conveyor belt 14 towards flip-over roller 16. The leading edge 11 of sleeve blank 12 falls downwards in the gap 26 formed between the flip-over roller 16 and the front face 36 of the lower hem guide 30. The sleeve 12 will glide over stripper arms 38 so that the blank is disengaged from the flip over roller 16. Note that as sleeve blank 12 falls, it comes to rest against the surface of clamp bar 24.

Figure 3:
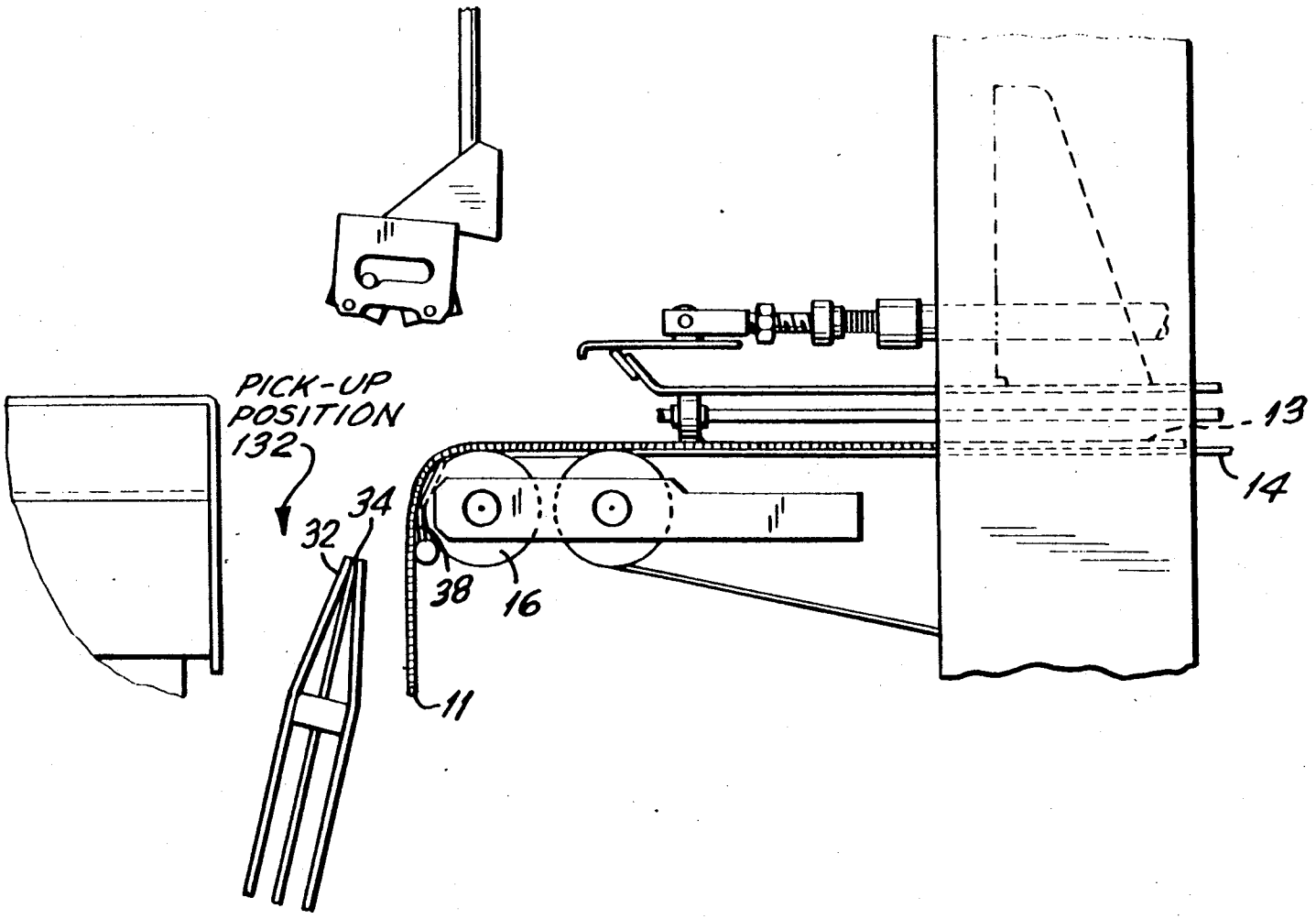
FIG. 3 is a side elevational view illustrating the lower hem guide at a sleeve pick-up position while the sleeve pick-up device is positioned to engage the sleeve blank.

As previously explained, since the conveyor speed and distance to the clamp bar 24 from sensor 54 are known, detection of the leading edge 11 by sensor 54 enables CPU 22 to determine when the leading edge 11 of sleeve blank 12 passes clamp bar 24. CPU 22 then activates first actuating cylinder 102, thereby rotating lower hem guide 30 from its home position 130 to pickup position 132 (FIG. 3). Advantageously, at pick-up position 132 the lower hem guide 30 remains disengaged from the clamp bar 24. A slight gap will exist between the tapered surface 36 of hem guide 30 and clamp bar 24 so that the sleeve blank 12 falls undisturbed between the clamp bar 24 and the hem guide 30. However, this new, narrower gap allows hem guide 30 the capacity to instantaneously clamp sleeve blank 12 against clamp bar 24 once commanded by CPU 22.

Figure 4:
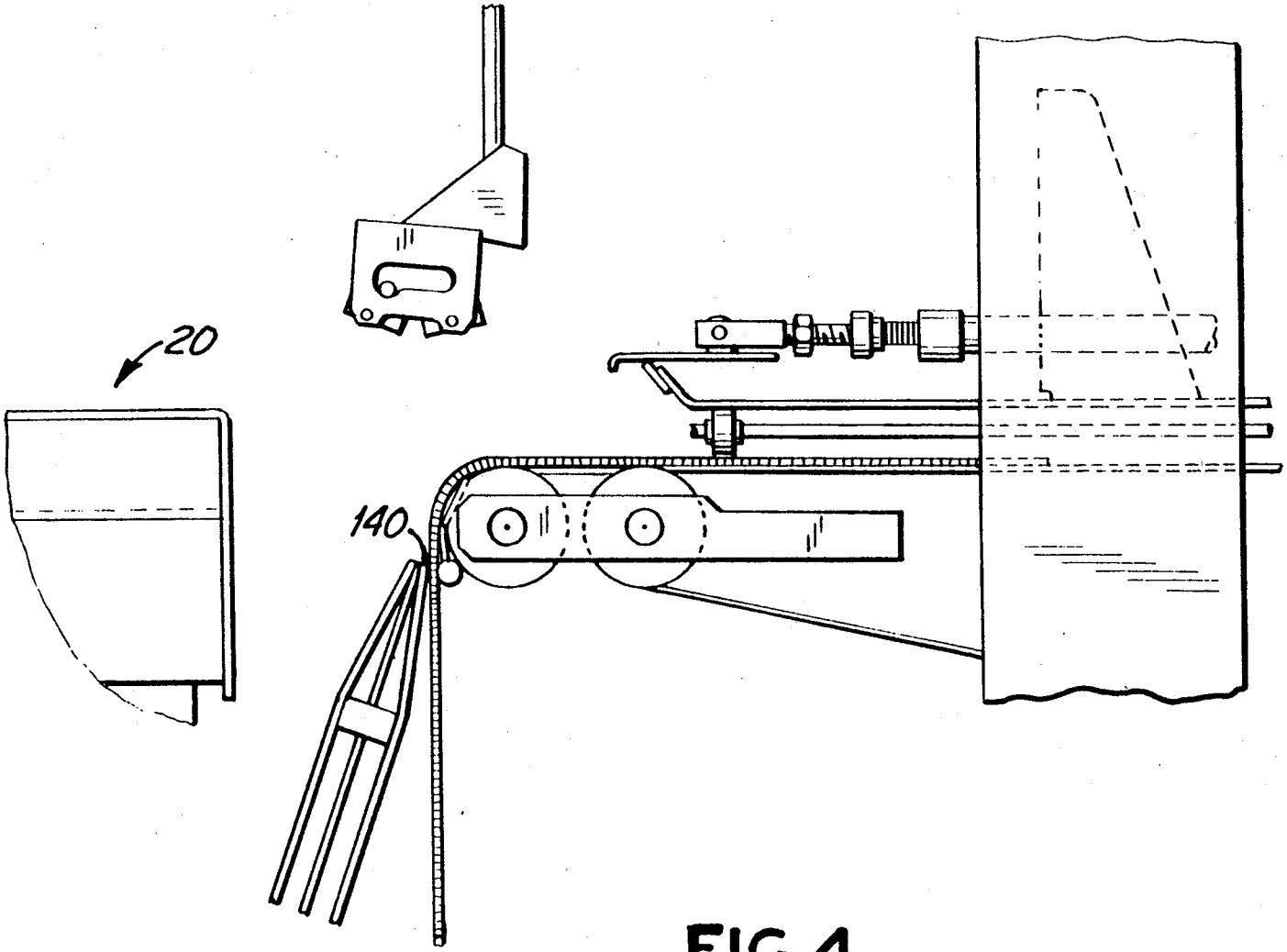
FIG. 4 is a side elevational view of the lower hem guide illustrating the lower hem guide clamped against the clamp bar.

FIG. 4 illustrates the hem guide 30 in its clamped position 134 against clamp bar 24 so as to have secured sleeve blank 12 therebetween. The sensor 54, having previously determined the length of the sleeve blank 12, and knowing the conveyor speed, allows CPU 22 to actuate second actuating cylinder 104 when the medial axis or other desired fold line 140 of sleeve blank 12 has passed the clamp bar 24. The lower hem guide 30 is thereby rotated from the pickup position 132 into clamping position 134. This secures the sleeve blank 12 against clamping bar 24, preventing further downward motion of the sleeve blank 12. Note that, preferably, the tapered edge 32 of hem guide 30 and the medial fold line 140 of sleeve blank 12 will substantially overlap once the sleeve blank 12 is clamped.

Figure 5:
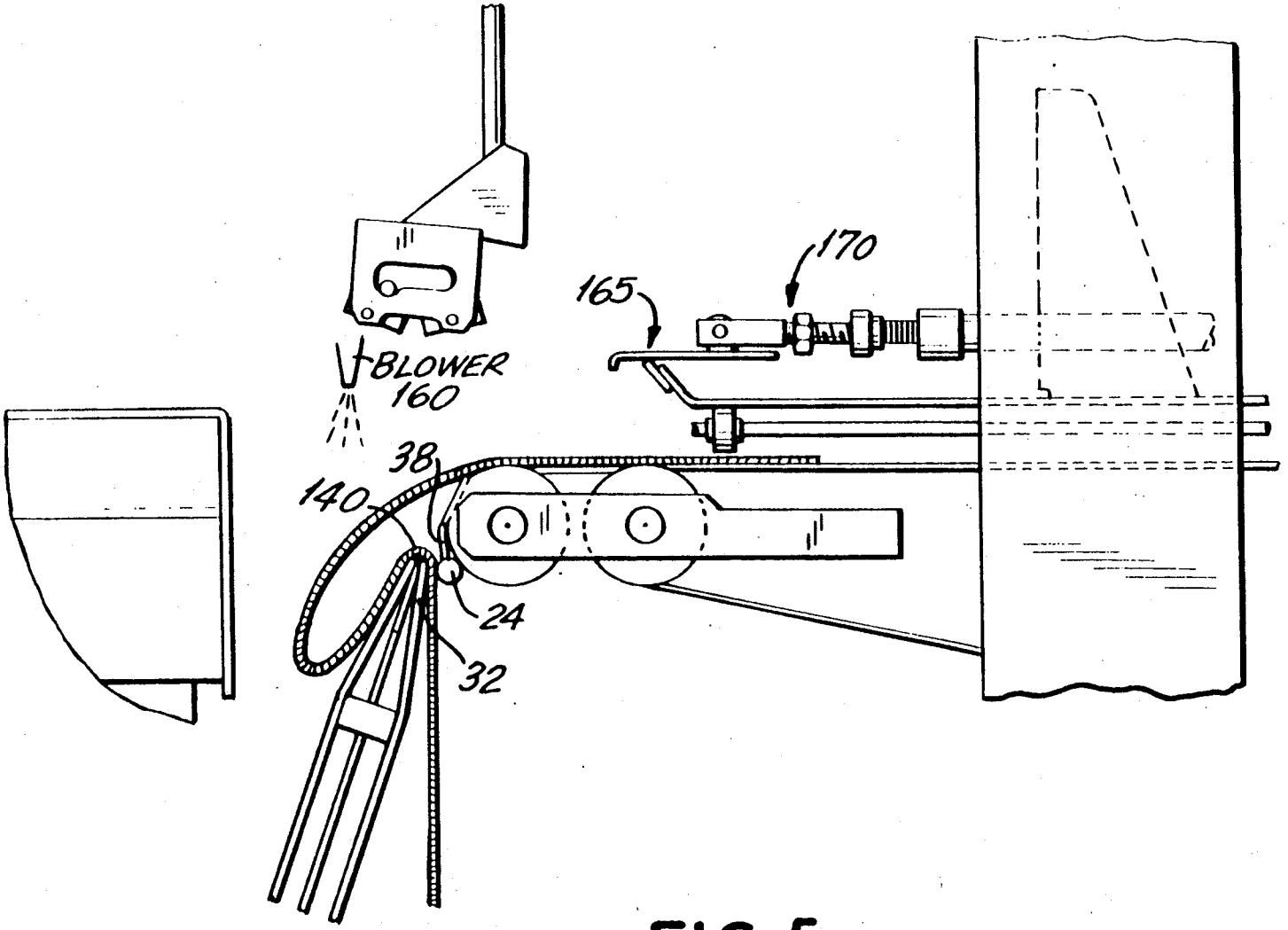
FIG. 5 is a side elevational view illustrating the flipping operation of the sleeve blank.

FIG. 5 illustrates the actual "flip-over" procedure of sleeve blank 12 along the medial fold line 140. The fold line 140 is preferably located along the medial axis of the sleeve blank 12, but other fold lines may be chosen according to need or device.

The trailing half of sleeve blank 12 continues to travel along conveyor 14 and over flip over roller 16. The CPU 22 then commands motor 18 to increase speed, thereby translating additional rotational speed to flip-over roller 16 via the belt assembly 20. The sudden increase in motor speed results in an inertial force being applied to the trailing half of sleeve blank 12. The trailing half of sleeve blank 12 thus "flips" over the tapered edge 32 of hem guide 30. Note that the flipping is aided by a blower 160 that blows downward onto the trailing half of sleeve blank 12 as the trailing half is flipping up and over the tapered edge 32 of lower hem guide 30. The leading half of sleeve blank 12 remains clamped between hem guide 30 and clamp bar 24. The sleeve blank 12 is thus reoriented from a right-side up position to an inside-out position. Note that the trailing half of sleeve blank 12 remains draped over the side of lower hem guide 30, so that sleeve blank 12 is now divided into two plies equally divided on both sides of lower hem guide 30.

Figure 6:
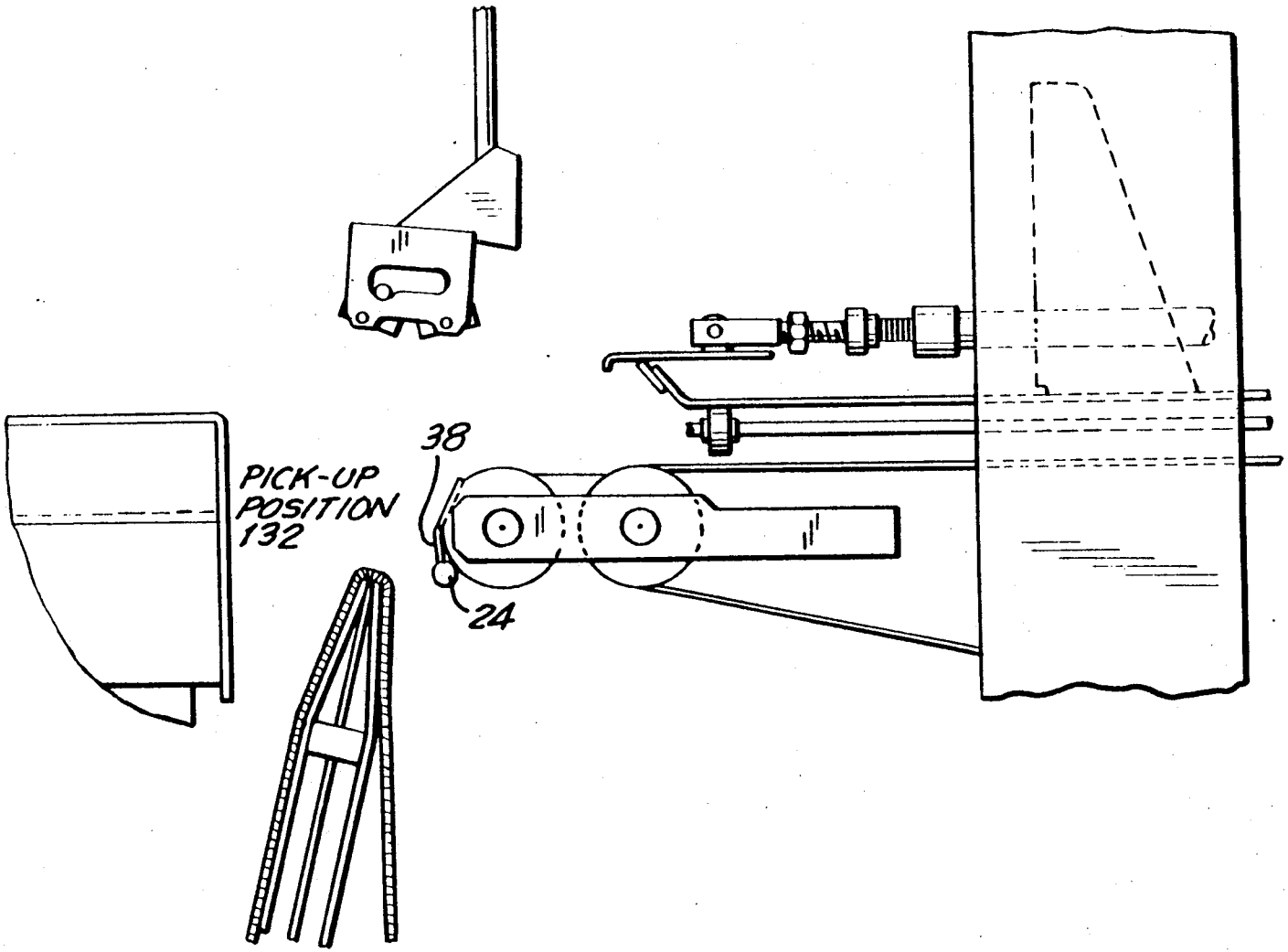
FIG. 6 is a side elevational view illustrating the flipped sleeve draped over the lower hem guide in the pick-up position.

Once the flipping operation is completed, second actuating cylinder 104 is deactuated so that lower hem guide 30 and sleeve blank 12 move away from engagement with clamp bar 24 to the pick-up position 132 (FIG. 6).

Simultaneously, sleeve pick-up device 70 has moved over the pick-up position 132, having previously deposited another sleeve blank onto index table 28. Sleeve pick-up device 70 is similar to that described in the '381 patent, having jaws 72, 74 which serve to clamp sleeve blank 12, as well as being actuated in a similar manner. The jaws 72, 74 are parted and substantially centered over the slotted opening 34 in the lower hem guide 30.

Figure 7:
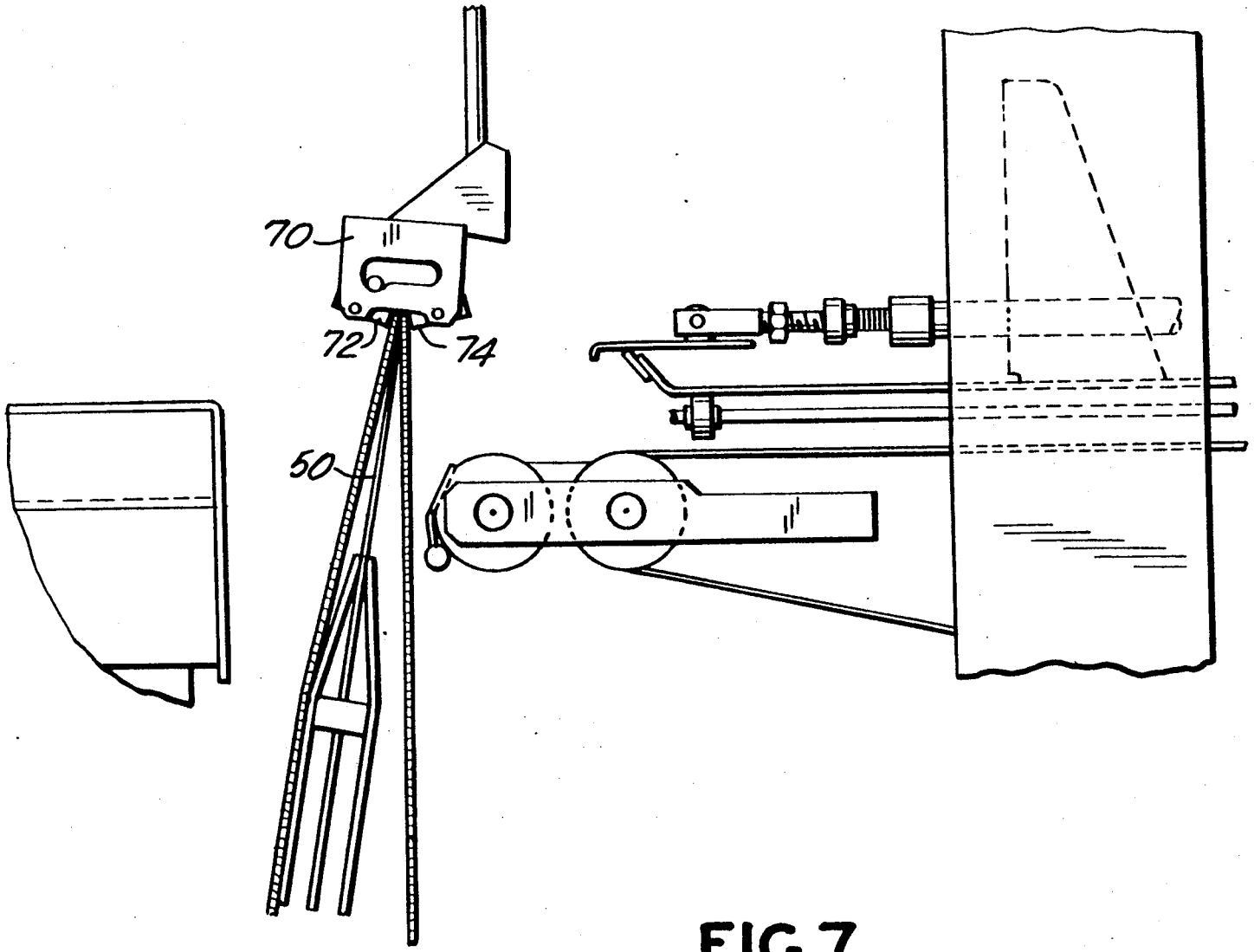
FIG. 7 is a side elevational view illustrating the divide-by-two blade lifting the sleeve blank into the jaws of the sleeve transport device.
Figure 8:
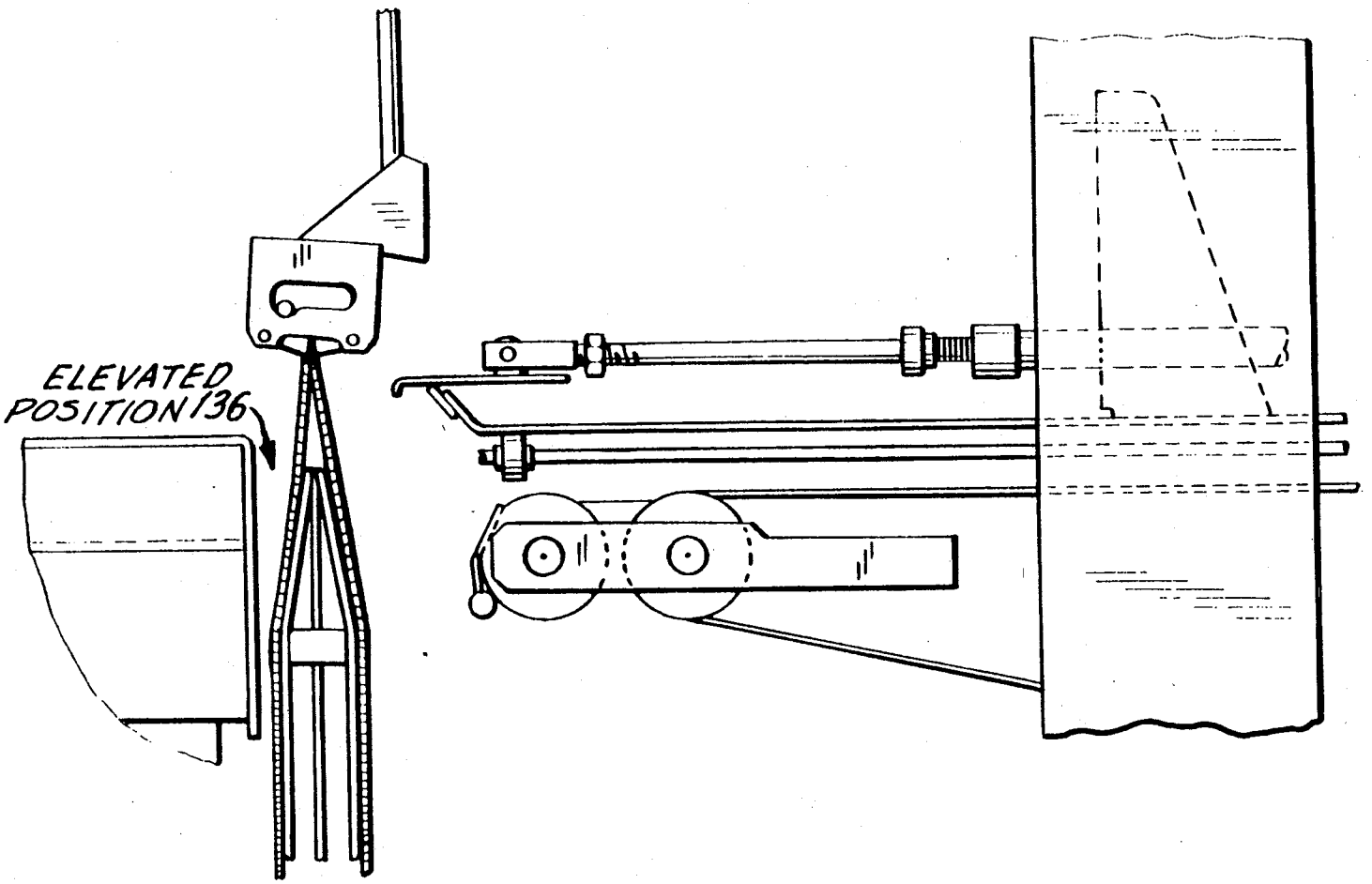
FIG. 8 is a side elevational view illustrating the sleeve transport device and lower hem guide raising and moving towards the drop-off table away from the conveyor belt.
Figure 9:
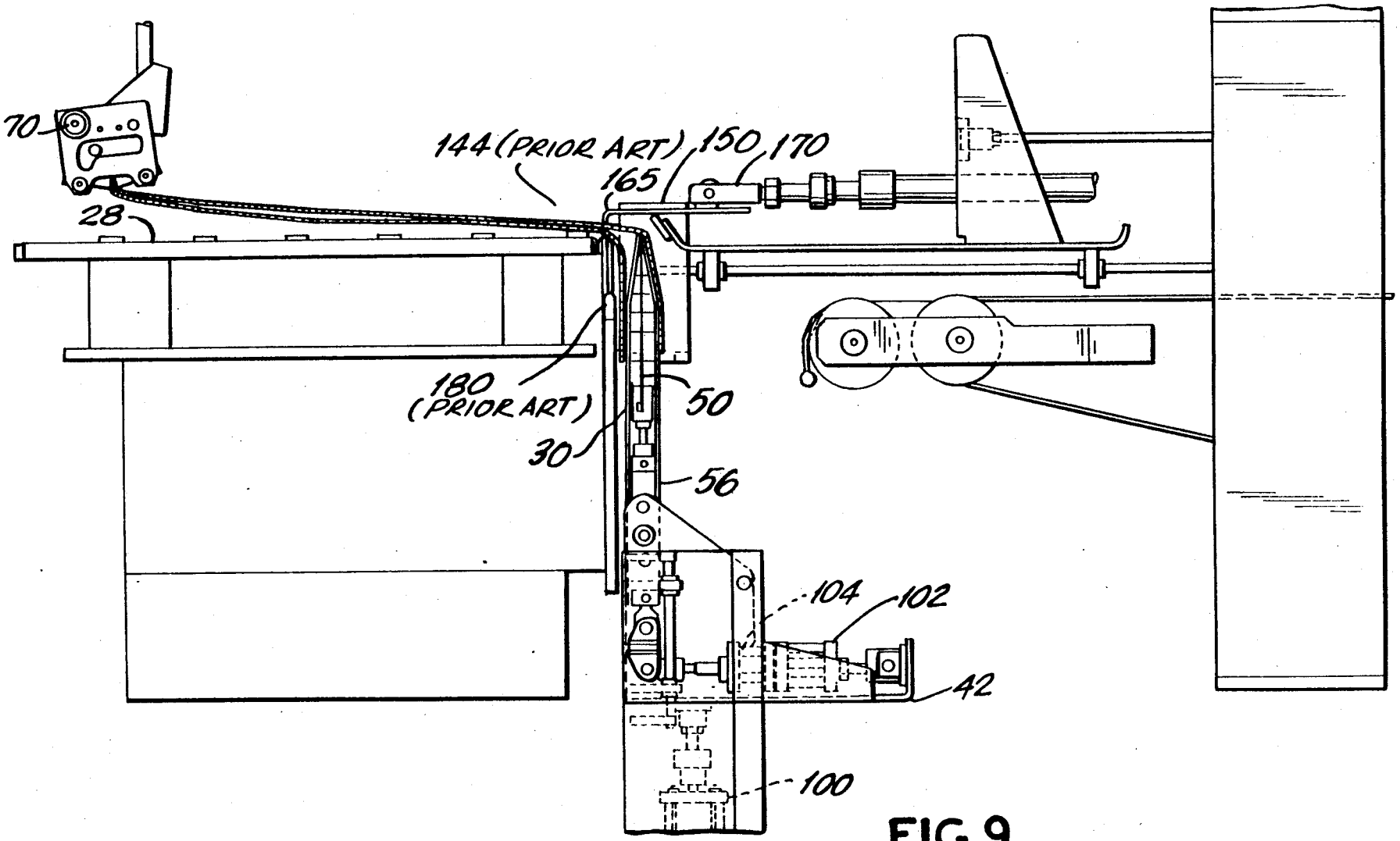
FIG. 9 is a side elevational view illustrating the trailing edge of the sleeve blank clamped against the index table prior to release by the pickup device.

Referring now to FIG. 7, the divide-by-two blade 50 is raised through the slotted opening 34 via cylinder 56, thereby raising sleeve blank 12 between the awaiting jaws 72, 74. The DBT blade 50 engages jaws 72, 74, so that the blade 50 urges jaws 72, 74 to close shut, thus securing sleeve blank 12 therebetween. The divide by two blade 50 then slides down between the plies of sleeve blank 12 and retracts through the slotted opening 34 of lower hem guide 30.

Once the sleeve blank 12 is securely gripped, the pickup device 70 may proceed towards index table 28. Simultaneously, lower hem guide 30 is actuated by cylinder 100 towards its up position 136 at the same time that first actuating cylinder 102 is deactuated so as to rotate hem guide 30 counterclockwise towards its home position 130. Note that the plies of sleeve blank 12 remain draped over the sides of guide 30. This simultaneous movement occurs as pick-up device 70 travels towards the surface of index table 28.

At the up position 136, the tapered edge 32 of the guide 30 is substantially level with the surface of index table 28. Simultaneously, pick-up device 70 continues to travel over index table 28 towards a user-designated release point for the sleeve blank 12.

Advantageously, raising the hem guide 30 to substantially the surface level of index table 28 helps to serve as a guide assuring accurate placement and maintaining the registration of sleeve blank 12 on the index table 28. The hem guide 30 gently guides the previously clamped, leading half of sleeve blank 12 over the tapered edge 32, simultaneously to which the previously unclamped trailing half of sleeve-blank 12 is being guided by the side of index table 28 onto the surface thereof. Significantly, this assures that the plies of sleeve blank 12 remain separated substantially until placement upon index table 28, allowing blowers 144, 180 (described in the '830 patent) to maintain registration of the sleeve blank against the plate 150. Moreover, since during the travel of sleeve blank 12 over index table 28 the plies of the sleeve blank 12 continue to drape over lower hem guide 30, raising the lower hem guide 30 further ensures that there Will be a gentler release of sleeve blank 12 from sleeve pickup 70.

As sleeve blank 12 arrives at its designated drop-off point on index table 28, the clamp 165 of an upper hem guide 170, such as described in the '830 patent, clamps the trailing ends of the sleeve blank 12 against the index table 28. This assures that the sleeve blank 12 will suffer no deleterious buckling or folds that will cause misseaming during later processing of the sleeve blank 12. Thus, the combined motion of the pick-up device 70 with the clamping action of clamp 165 imparts a slight tension to sleeve bank 12, assuring both proper alignment and that sleeve blank 12 will lay flat on index table 28.

Pick-up device 70 now arrives at its previously designated drop off location over index table 28. The jaws 72, 74 open, thereby releasing the folded sleeve blank 12 onto the surface of index table 28. The clamp 165 next releases, so that sleeve blank 12 lays flat upon index table 28, from where it may be transported for a further manufacturing operation such as a seaming operation.

The lower hem guide 30 is now lowered to its home position 130, while the sleeve pickup device 70 travels back towards the pick-up position 132, so that a subsequent sleeve blank may be procured.

Thus, the invention provides an efficient way to reorient workpieces from a right side-up orientation to an inside-out orientation so as to properly present the workpieces for a seaming or other stitching operation.

It will be apparent that other and further forms of the invention may be devised without departing from the spirit and scope of the appended claims, it being understood that this invention is not to be limited to the specific embodiments shown.

We claim:

1. A flip-over device for folding a flat pliable workpiece about a pre-determined axis comprising:
   a central processing unit (CPU) for controlling the operation of said device;
   a flipping roller for imparting linear momentum to said pliable workpiece, said roller being actuated via a motor controlled by said CPU;
   an apparel guide having a tapered edge about which said pliable workpiece is folded, said guide pivotedly mounted for movement towards and away from said flip-over roller, said guide having a plurality of user-determinable positions; and
   a clamping bar mounted between said apparel guide and said roller, said pliable workpiece resting against said bar as said workpiece travels over said roller, and said apparel guide clamping against said clamping bar so as to secure said pliable workpiece therebetween.

2. A flip-over device according to claim 1, wherein said apparel guide further comprises a dividing blade mounted within the interior of said guide, said blade portrudable through a slotted opening along said tapered edge of said guide.

3. A flip-over device according to claim 1, further comprising a workpiece sensing device for detecting the leading and trailing edges of said workpiece, said sensing device being located a known distance from said clamping bar.

4. A flip-over device according to claim 3, wherein said sensing device relays signals to said CPU responsive to detecting the leading and trailing edges of said workpiece, and said CPU determines the length of said workpiece from the time interval between said signals and speed of said workpiece.

5. A flip-over device for folding about a predetermined axis a flattened pliable workpiece, comprising:
   a central processing unit (CPU) for controlling the operation of said device;
   a flipping roller for imparting linear momentum to said pliable workpiece, said roller activated via a motor controlled by said CPU;
   an apparel guide having a tapered edge about which said pliable workpiece is folded, said guide pivotedly mounted for movement towards and away from said flip-over roller so as to have a plurality of user-determinable position;
   a workpiece transport for transporting said workpiece from said apparel guide to a dropoff surface, said transport securing said workpiece in a folded condition about said pre-determined axis;
   a dividing blade for dividing said workpiece about said pre-determined axis, said blade mounted within the interior of said apparel guide, said guide protrudable through a slotted opening along said tapered edge of said guide to lift said workpiece towards said transport; and
   a clamping bar mounted between said apparel guide and said roller, said pliable workpiece resting against said bar as said workpiece travels over said roller, and said apparel guide clamping against said clamping bar so as to secure said pliable workpiece therebetween.

6. A flip-over device according to claim 5, further comprising means for determining the length of said workpiece, wherein said means comprises a sensing device of detecting the leading and trailing edges of said workpiece and positioned a known distance from said clamping bar so as to determine when said predetermined axis of said workpiece passes said clamping bar, said sensing device relaying signals to said CPU responsive to detecting the leading and trailing edges of said workpiece to enable said CPU to ascertain the length of said workpiece form the interval between receiving said signals and speed of said workpiece.

7. A flip-over device according to claim 6, further comprising a clamping device for clamping said pliable workpiece against said dropoff surface.

8. A method for flipping and folding a pliable workpiece about a pre-determined axis, comprising the steps of:
   passing said workpiece over a flip-over-roller;
   allowing said workpiece to fall over a clamping bar below said flip-over roller;
   clamping said workpiece against said clamping bar with an apparel guide at a predetermined time that corresponds to the dimensions of said workpiece and to its rate of fall over said roller, so that said workpiece will be clamped by said apparel guide about said predetermined axis; and
   increasing the rotational speed of said roller so that an inertial force is imparted to the unclamped portion of said workpiece, causing said portion to flip over said apparel guide so that said workpiece will be divided into separate plies and folded about said pre-determined axis.

9. The flipping and folding method of claim 8, wherein said method further comprises the step of lifting said folded workpiece along its pre-determined axis to a transport device, and securing said folded workpiece by said transport device for transporting said folded workpiece to an index table.

10. The flipping and folding method of claim 9, wherein said method further comprises the step of maintaining the plies of said folded workpiece separate during the transporting of said workpiece to said index table.

11. A flip-over device according to claim 1, wherein said flipping roller imparts linear momentum to said pliable workpiece by increasing the rotational speed of said flipping roller via said motor.

12. A flip-over device according to claim 5, wherein said flipping roller imparts linear momentum to said pliable workpiece by increasing the rotational speed of said roller via said motor.

13. A flip-over device according to claim 1, wherein said pre-determined axis comprises the medial axis of said workpiece.

14. A flip-over device according to claim 5, wherein said pre-determined axis comprises the medial axis of said workpiece.

15. A flip-over device according to claim 5, wherein said flipping roller is covered with a surfacing material to impart friction to said sleeve blank during the flip-over operation.

16. A flip-over device according to claim 5, further comprising a plurality of stripper arms mounted adjacent to said flipping roller for assisting in disengaging said workpiece from said flipping roller.

17. A flip-over device according to claim 5, wherein said apparel guide further comprises a carriage and rail assembly having an actuating cylinder for raising and lowering said apparel guide.

18. A flip-over device according to claim 17, wherein said carriage and rail assembly further comprises a plurality of actuating cylinders for actuating said movement of said apparel guide towards and away from said flip-over roller.

* * * * *